US007306213B2

(12) United States Patent
Terao et al.

(10) Patent No.: US 7,306,213 B2
(45) Date of Patent: Dec. 11, 2007

(54) SHEET POST-PROCESS DEVICE WITH STANDBY TRAY

(75) Inventors: Yasunobu Terao, Shizuoka-ken (JP); Yoshiaki Sugizaki, Shizuoka-ken (JP); Mikio Yamamoto, Shizuoka-ken (JP); Tomomi Iijima, Shizuoka-ken (JP); Hiroyuki Taki, Shizuoka-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 4 days.

(21) Appl. No.: 11/085,248

(22) Filed: Mar. 22, 2005

(65) Prior Publication Data

US 2006/0066041 A1 Mar. 30, 2006

(30) Foreign Application Priority Data

Sep. 29, 2004 (JP) ..... 2004-285284
Dec. 17, 2004 (JP) ..... 2004-366522

(51) Int. Cl.
*B65H 37/04* (2006.01)

(52) U.S. Cl. ..... 270/58.08; 270/58.11; 270/58.12; 270/58.13; 270/58.14; 270/58.18; 271/189; 271/190; 271/191; 271/192; 399/410

(58) Field of Classification Search ..... 270/58.08, 270/58.11, 58.12, 58.13, 58.14, 58.18; 399/410; 271/189, 190, 191, 192
See application file for complete search history.

(56) References Cited

U.S. PATENT DOCUMENTS 4,473,425 A 9/1984 Baughman et al.
4,611,741 A 9/1986 Wilson
4,794,859 A 1/1989 Huseby et al.
4,849,796 A 7/1989 Murakami (Continued)

FOREIGN PATENT DOCUMENTS

JP 61-078162 U 5/1986

(Continued)

OTHER PUBLICATIONS

U.S. Appl. No. 11/085,247, filed Mar. 22, 2005, Terao et al.

(Continued)

*Primary Examiner*—Gene O. Crawford
*Assistant Examiner*—Leslie A Nicholson, III
(74) *Attorney, Agent, or Firm*—Foley & Lardner LLP

(57) ABSTRACT

Above a processing tray, a standby tray for making sheets of paper P stand by is installed. The sheets of paper P on the standby tray are dropped, fed, and moved to the processing tray, thus the conveying path from the standby tray to the processing tray is shortened. A conveyor belt is arranged at an angle with the processing tray so that the front end side of the sheets is positioned higher than the rear end side thereof and the conveyor belt on the front end side of the sheets is projected from the processing tray. By doing this, frictional force of the conveyor belt with the sheets of paper P on the rear end side is made smaller, and frictional force with the sheets of paper P on the front end side is made larger, and the ejectability of sheets from the processing tray after ending of the post process is improved.

14 Claims, 11 Drawing Sheets

U.S. PATENT DOCUMENTS 4,898,374 A 2/1990 Vermaat
4,917,366 A 4/1990 Murakami et al.
5,020,784 A 6/1991 Asami et al.
5,021,837 A 6/1991 Uto et al.
5,098,074 A 3/1992 Mandel et al.
5,282,611 A 2/1994 Ueda et al.
5,285,249 A 2/1994 Mahoney
5,289,251 A 2/1994 Mandel et al.
5,337,134 A 8/1994 Sato et al.
5,370,384 A * 12/1994 Romanowski ..... 271/297
5,418,606 A 5/1995 Kikuchi et al.
5,435,544 A 7/1995 Mandel
5,449,157 A 9/1995 Kawano et al.
5,451,037 A 9/1995 Lundstrom
5,590,871 A * 1/1997 Okabe et al. ..... 270/58.27
5,622,359 A 4/1997 Kawano et al.
5,628,502 A 5/1997 Amarakoon
5,640,232 A 6/1997 Miyake et al.
5,676,517 A 10/1997 Lotz
5,709,376 A * 1/1998 Ushirogata ..... 270/58.11
5,934,140 A 8/1999 Jackson et al.
5,961,274 A 10/1999 Bors
5,971,384 A 10/1999 Asao
6,022,011 A 2/2000 Hirose
6,065,747 A 5/2000 Khovaylo et al.
6,092,948 A 7/2000 Altfather
6,102,385 A 8/2000 Wakamatsu et al.
6,120,020 A 9/2000 Asao
6,142,461 A 11/2000 Asao et al.
6,145,828 A 11/2000 Arai
6,146,085 A 11/2000 Namba et al.
6,179,287 B1 1/2001 Watanabe et al.
6,231,039 B1 5/2001 Chung
6,330,999 B2 * 12/2001 Coombs et al. ..... 270/58.18
6,336,630 B1 1/2002 Holtman et al.
6,354,059 B1 3/2002 Yoshie et al.
6,357,753 B1 3/2002 Yamasaki et al.
6,371,472 B1 4/2002 Miyake et al.
6,450,934 B1 9/2002 Coombs
6,505,829 B2 1/2003 Kawata
6,561,922 B2 6/2003 Kuwata et al.
6,600,885 B2 7/2003 Kida
6,641,129 B2 11/2003 Ogita et al.
6,659,455 B2 12/2003 Endo et al.
6,671,492 B2 12/2003 Mimura et al.
6,674,983 B2 1/2004 Enomoto et al.
6,698,744 B2 3/2004 Yamada et al.
6,712,349 B2 3/2004 Watanabe
6,722,646 B2 4/2004 Sekiyama et al.
6,722,650 B1 4/2004 Abbata et al.
6,733,006 B2 5/2004 Kobayashi et al.
6,733,007 B2 5/2004 Sekiyama et al.
6,767,012 B2 7/2004 Sasamoto
6,819,906 B1 11/2004 Herrmann et al.
6,824,128 B2 11/2004 Nagata et al.
6,848,685 B2 2/2005 Katsuyama
6,871,042 B2 3/2005 Nemura et al.
6,910,686 B2 6/2005 Awano
6,928,259 B2 8/2005 Sakuma
6,988,728 B2 1/2006 Kida
7,104,538 B1 * 9/2006 Kimura et al. ..... 270/58.08
2002/0047233 A1 4/2002 Coombs et al.
2002/0053766 A1 * 5/2002 Kubota ..... 270/58.08
2002/0074708 A1 6/2002 Nagata et al.
2002/0163119 A1 11/2002 Kawata
2003/0057625 A1 3/2003 Kuwata et al.
2003/0155705 A1 8/2003 Sekiyama et al.
2003/0214090 A1 11/2003 Kato et al.
2004/0032073 A1 2/2004 Sasamoto
2004/0113348 A1 6/2004 Awano
2004/0126163 A1 7/2004 Asami et al.
2004/0181308 A1 9/2004 Hayashi et al.
2005/0000336 A1 1/2005 Hattori et al.

FOREIGN PATENT DOCUMENTS

JP 62-008965 A 1/1987
JP 63-035756 U 3/1988
JP 63-180673 A 7/1988
JP 02-055369 A 2/1990
JP 03-088667 A 4/1991
JP 04-079857 U 7/1992
JP 04-312894 A 11/1992
JP 04-354756 A 12/1992
JP 05-238103 A 9/1993
JP 6-099070 B2 12/1994
JP 08-259073 A 10/1996
JP 10-095563 A 4/1998
JP 10-279169 A 10/1998
JP 10-324449 A 12/1998
JP 11-011786 A 1/1999
JP 11-043257 A 2/1999
JP 11-147641 A 6/1999
JP 11-208967 A 8/1999
JP 11-231753 A 8/1999
JP 11-301912 A 11/1999
JP 11-322162 A 11/1999
JP 2000-095420 A 4/2000
JP 2000-159414 A 6/2000
JP 2001-048411 A 2/2001
JP 2001-089009 A 4/2001
JP 2001-316029 A 11/2001
JP 2002-060118 A 2/2002
JP 2002-308509 A 10/2002
JP 2003-081517 3/2003
JP 2003081517 A * 3/2003
JP 2003-171057 A 6/2003
JP 2003-246536 A 9/2003
JP 2003-335450 A 11/2003
JP 2004-142868 A 5/2004

OTHER PUBLICATIONS

U.S. Appl. No. 11/085,226, filed Mar. 22, 2005, Terao et al.
U.S. Appl. No. 11/085,227, filed Mar. 22, 2005, Terao et al.
U.S. Appl. No. 11/085,244, filed Mar. 22, 2005, Terao et al.
U.S. Appl. No. 11/085,243, filed Mar. 22, 2005, Terao et al.
U.S. Appl. No. 11/085,242, filed Mar. 22, 2005, Terao et al.
U.S. Appl. No. 11/085,241, filed Mar. 22, 2005, Terao et al.
U.S. Appl. No. 11/085,250, filed Mar. 22, 2005, Terao et al.
U.S. Appl. No. 11/085,240, filed Mar. 22, 2005, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,222, filed Dec. 10, 2004, Terao et al.
U.S. Appl. No. 11/008,381, filed Dec. 10, 2004, Terao et al.
U.S. Appl. No. 11/008,132, filed Dec. 10, 2004, Terao et al.
U.S. Appl. No. 11/008,131, filed Dec. 10, 2004, Terao et al.
U.S. Appl. No. 11/008,142, filed Dec. 10, 2004, Terao et al.
U.S. Appl. No. 11/008,199, filed Dec. 10, 2004, Terao et al.
U.S. Appl. No. 11/008,145, filed Dec. 10, 2004, Terao et al.
U.S. Appl. No. 11/008,124, filed Dec. 10, 2004, Terao et al.
U.S. Appl. No. 11/008,350, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,349, filed Dec. 10, 2004, Terao et al.
U.S. Appl. No. 11/008,294, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,290, filed Dec. 10, 2004, Terao et al.
U.S. Appl. No. 11/008,392, filed Dec. 10, 2004, Terao et al.
U.S. Appl. No. 11/008,299, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,295, filed Dec. 10, 2004, Terao et al.
U.S. Appl. No. 11/008,251, filed Dec. 10, 2004, Terao et al.

U.S. Appl. No. 11/008,122, filed Dec. 10, 2004, Sasahara.
U.S. Appl. No. 11/008,567, filed Dec. 10, 2004, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., Notice of Allowance and Fee(s) Due, U.S. Appl. No. 11/008,132, Oct. 6, 2005, 9 pages.
Y. Terao et al., U.S. PTO Notice of Allowance, U.S. Appl. No. 11/085,243, Jan. 5, 2006, with attached Notice of Withdrawal from Issue dated Jan. 10, 2006, 10 pgs.
Y. Terao et al., U.S. PTO Office Action, U.S. Appl. No. 11/008,122, Nov. 21, 2005, 9 pages.
Y. Terao et al., U.S. PTO Office Action, U.S. Appl. No. 11/008,131, Feb. 23, 2006, 9 pgs.
Y. Terao et al., U.S. PTO Office Action, U.S. Appl. No. 11/008,148, Jan. 11, 2006, 12 pages.
Y. Terao et al., U.S. PTO Office Action, U.S. Appl. No. 11/008,222, Feb. 24, 2006, 12 pgs.
Y. Terao et al., U.S. PTO Office Action, U.S. Appl. No. 11/008,224, Nov. 21, 2005, 9 pages.
Y. Terao et al., U.S. PTO Office Action, U.S. Appl. No. 11/008,230, Feb. 24, 2006, 11 pgs.
Y. Terao et al., U.S. PTO Office Action, U.S. Appl. No. 11/008,251, Jan. 13, 2006, 11 pages.
Y. Terao et al., U.S. PTO Office Action, U.S. Appl. No. 11/008,257, Nov. 30, 2005, 9 pages.
Y. Terao et al., U.S. PTO Office Action, U.S. Appl. No. 11/008,271, Nov. 30, 2005, 9 pages.
Y. Terao et al., U.S. PTO Office Action, U.S. Appl. No. 11/008,290, Nov. 30, 2005, 9 pages.
Y. Terao et al., U.S. PTO Office Action, U.S. Appl. No. 11/008,295, Jan. 5, 2006, 11 pages.
Y. Terao et al., U.S. PTO Office Action, U.S. Appl. No. 11/008,350, Jan. 26, 2006, 12 pages.
Y. Terao et al., U.S. PTO Office Action, U.S. Appl. No. 11/008,392, Dec. 14, 2005, 9 pages.
Y. Terao et al., U.S. PTO Office Action, U.S. Appl. No. 11/085,226, Jan. 13, 2006, 9 pgs.
Y. Terao et al., U.S. PTO Office Action, U.S. Appl. No. 11/085,227, Feb. 9, 2006, 9 pgs.
Y. Terao et al., U.S. PTO Office Action, U.S. Appl. No. 11/085,240, Jan. 26, 2006, 8 pgs.
Y. Terao et al., U.S. PTO Office Action, U.S. Appl. No. 11/085,241, Feb. 9, 2006, 9 pgs.
Y. Terao et al., U.S. PTO Office Action, U.S. Appl. No. 11/085,243, Jan. 26, 2006, 6 pgs.
Y. Terao et al., U.S. PTO Office Action, U.S. Appl. No. 11/085,244, Feb. 9, 2006, 7 pgs.
Y. Terao et al., U.S. PTO Office, U.S. Appl. No. 11/008,294, Dec. 13, 2005, 9 pages.
Y. Terao et al., U.S. PTO Office, U.S. Appl. No. 11/008,299, Dec. 13, 2005, 9 pages.
Y. Terao et al., U.S. PTO Office, U.S. Appl. No. 11/008,349, Dec. 13, 2005, 9 pages.
Y. Terao et al., U.S. PTO Office, U.S. Appl. No. 11/008,567, Dec. 13, 2005, 9 pages.
Y. Terao, et al., Notice of Allowance and Fee(s) Due, U.S. Appl. No. 11/008,124, Sep. 30, 2005, 9 pages.
K. Sasahara et al., U.S. PTO Office Action, U.S. Appl. No. 11/008,122, Apr. 19, 2006, 10 pages.
Y. Terao et al., Notice of Allowance and Fee(s) Due, U.S. Appl. No. 11/008,199, Apr. 20, 2006, 15 pages.
Y. Terao et al., Notice of Allowance and Fee(s) Due, U.S. Appl. No. 11/008,247, May 1, 2006, 16 pages.
Y. Terao et al., Notice of Allowance and Fee(s) Due, U.S. Appl. No. 11/008,349, May 2, 2005, 9 pages.
Y. Terao et al., U.S. PTO Office Action, U.S. Appl. No. 11/008,224, Apr. 21, 2006, 12 pages.
Y. Terao et al., U.S. PTO Office Action, U.S. Appl. No. 11/008,257, Apr. 28, 2006, 13 pages.
Y. Terao et al., U.S. PTO Office Action, U.S. Appl. No. 11/008,271, 004-25-2006, 14 pages.
Y. Terao et al., U.S. PTO Office Action, U.S. Appl. No. 11/008,294, May 5, 2006 13 pages.
Y. Terao et al., U.S. PTO Office Action, U.S. Appl. No. 11/008,299, May 5, 2006, 12 pages.
Y. Terao et al., U.S. PTO Office Action, U.S. Appl. No. 11/008,392, Apr. 26, 2006, 10 pages.
Y. Terao et al., Notice of Allowance and Fee(s) Due, U.S. Appl. No. 11/008,148, Jun. 26, 2006, 10 pages.
Y. Terao et al., Notice of Allowance and Fee(s) Due, U.S. Appl. No. 11/008,251, Jun. 26, 2006, 10 pages.
Y. Terao et al., Notice of Allowance and Fee(s) Due, U.S. Appl. No. 11/085,241, Jun. 26, 2006, 10 pages.
Y. Terao et al., Notice of Allowance and Fee(s) Due, U.S. Appl. No. 11/085,243, Jun. 26, 2006, 10 pages.
Y. Terao et al., U.S. PTO Office Action, U.S. Appl. No. 11/008,132, Jun. 9, 2006, with attached Notice of Withdrawal from Issue dated May 30, 2006, 11 pgs.
Y. Terao et al., U.S. PTO Office Action, U.S. Appl. No. 11/008,295, Jun. 23, 2006, 14 pgs.
Y. Terao et al., Notice of Allowance and Fee(s) Due, U.S. Appl. No. 11/085,244, Jul. 13, 2006, 10 pages.
Y. Terao et al., U.S. PTO Office Action, U.S. Appl. No. 11/008,145, Jun. 30, 2006, 6 pgs.
Y. Terao et al., U.S. PTO Office Action, U.S. Appl. No. 11/008,147, Jul. 7, 2006, 4 pgs.
Y. Terao et al., U.S. PTO Office Action, U.S. Appl. No. 11/008,290, Jul. 21, 2006, 15 pgs.
Y. Terao et al., U.S. PTO Office Action, U.S. Appl. No. 11/008,350, Jul. 6, 2006, 12 pgs.
Y. Terao et al., U.S. PTO Office Action, U.S. Appl. No. 11/085,226, Jul. 20, 2006, 12 pages.
Y. Terao et al., U.S. PTO Office Action, U.S. Appl. No. 11/085,227, Aug. 11, 2006, 15 pages.
Y. Terao et al., U.S. PTO Office Action, U.S. Appl. No. 11/085,240, Aug. 2, 2006, 15 pages.
Y. Terao et al., U.S. PTO Office Action, U.S. Appl. No. 11/085,247, Jul. 13, 2006, 14 pgs.
Y. Terao et al., U.S. PTO Office Action, U.S. Appl. No. 11/085,256, Jul. 13, 2006, 13 pgs.
Y. Terao et al., U.S. PTO Office Action, U.S. Appl. No. 11/085,625, Jul. 28, 2006, 13 pgs.
Y. Terao, et al., Notice of Allowance and Fee(s) Due, U.S. Appl. No. 11/008,122, Jul. 26, 2006, 8 pgs.
Y. Terao et al., Notice of Allowance and Fee(s) Due, U.S. Appl. No. 11/008,142, Jan. 5, 2007, 24 pages.
Y. Terao et al., Notice of Allowance and Fee(s) Due, U.S. Appl. No. 11/008,145, Dec. 14, 2006, 20 pages.
Y. Terao et al., Notice of Allowance and Fee(s) Due, U.S. Appl. No. 11/008,147, Nov. 17, 2006, 7 pages.
Y. Terao et al., U.S. PTO Office Action, U.S. Appl. No. 11/008,248, Jan. 8, 2007, 25 pgs.
Y. Terao et al., Notice of Allowance and Fee(s) Due, U.S. Appl. No. 11/008,295, Sep. 21, 2006, 7 pages.
Y. Terao et al., Notice of Allowance and Fee(s) Due, U.S. Appl. No. 11/008,350, Sep. 21, 2006, 7 pages.
Y. Terao et al., Notice of Allowance and Fee(s) Due, U.S. Appl. No. 11/008,392, Sep. 15, 2006, 10 pages.
Y. Terao et al., U.S. PTO Office Action, U.S. Appl. No. 11/008,381, Aug. 23, 2006, 17 pages.
Y. Terao et al., U.S. PTO Office Action, U.S. Appl. No. 11/008,567, Aug. 21, 2006, 14 pages.
Y. Terao, et al., Notice of Allowance and Fee(s) Due, U.S. Appl. No. 11/008,222, Aug. 31, 2006, 12 pgs.
Y. Terao, et al., Notice of Allowance and Fee(s) Due, U.S. Appl. No. 11/008,299, Sep. 6, 2006, 9 pgs.
Y. Terao et al., U.S. PTO Office Action, U.S. Appl. No. 11/008,131, Oct. 17, 2006, 15 pages.
Y. Terao et al., U.S. PTO Office Action, U.S. Appl. No. 11/008,132, Nov. 24, 2006, 16 pages.
Y. Terao et al., U.S. PTO Office Action, U.S. Appl. No. 11/008,224, Nov. 17, 2006, 13 pages.

Y. Terao et al., U.S. PTO Office Action, U.S. Appl. No. 11/008,230, Nov. 13, 2006, 17 pages.
Y. Terao et al., U.S. PTO Office Action, U.S. Appl. No. 11/008,294, Oct. 24, 2006, 11 pages.
Y. Terao et al., U.S. PTO Office Action, U.S. Appl. No. 11/085,625, Nov. 21, 2006, 13 pages.
Y. Terao, et al., Notice of Allowance and Fee(s) Due, U.S. Appl. No. 11/008,257, Oct. 24, 2006, 11 pgs.
C. Iizuka et al., U.S. PTO Office Action, U.S. Appl. No. 11/085,251, Jun. 25, 2007, 28 pgs.
Y. Terao et al., Notice of Allowance and Fee(s) Due, U.S. Appl. No. 11/008,132, Jun. 1, 2007, 11 pgs.
Y. Terao et al., Notice of Allowance and Fee(s) Due, U.S. Appl. No. 11/008,294, Jun. 14, 2007, 6 pgs.
Y. Terao et al., Notice of Allowance and Fee(s) Due, U.S. Appl. No. 11/008,381, Jun. 29, 2007, 6 pgs.
Y. Terao et al., U.S. PTO Office Action, U.S. Appl. No. 11/085,242, Jul. 10, 2007, 9 pgs.
Y. Terao et al., U.S. PTO Office Action, U.S. Appl. No. 11/085,250, Jun. 20, 2007, 24 pgs.
Y. Terao et al., U.S. PTO Office Action, U.S. Appl. No. 11/085,625, Jul. 10, 2007, 11 pgs.
Y. Terao et al., Notice of Allowance and Fee(s) Due, U.S. Appl. No. 11/008,294, Feb. 6, 2007, 7 pages.
Y. Terao et al., Notice of Allowance and Fee(s) Due, U.S. Appl. No. 11/008,381, Feb. 22, 2007, 23 pages.
Y. Terao et al., Notice of Allowance and Fee(s) Due, U.S. Appl. No. 11/008,567, Mar. 1, 2007, 6 pages.
Y. Terao et al., Notice of Allowance and Fee(s) Due, U.S. Appl. No. 11/085,247, Feb. 28, 2007, 14 pages.
Y. Terao et al., U.S. PTO Office Action, U.S. Appl. No. 11/008,131, Feb. 8, 2007, 22 pages.
Y. Terao et al., U.S. PTO Office Action, U.S. Appl. No. 11/008,224, Feb. 28, 2007, 11 pages.
Y. Terao et al., U.S. PTO Office Action, U.S. Appl. No. 11/085,226, Jan. 29, 2007, 6 pages.
Y. Terao et al., U.S. PTO Office, U.S. Appl. No. 11/008,290, Mar. 9, 2007, 8 pages.
Y. Terao et al., U.S. PTO Office, U.S. Appl. No. 11/085,240, Mar. 12, 2007, 15 pages.
Y. Terao et al., U.S. PTO Office, U.S. Appl. No. 11/085,242, Mar. 23, 2007, 20 pages.
Y. Terao et al., U.S. PTO Office, U.S. Appl. No. 11/085,257, Mar. 23, 2007, 23 pages.
Y. Terao et al., U.S. PTO Office, U.S. Appl. No. 11/085,264, Mar. 23, 2007, 21 pages.
Y. Terao et al., Notice of Allowance and Fee(s) Due, U.S. Appl. No. 11/008,290, Aug. 2, 2007, 9 pages.
Y. Terao et al., Notice of Allowance and Fee(s) Due, U.S. Appl. No. 11/008,299, Jul. 23, 2007, 10 pages.
Y. Terao et al., Notice of Allowance and Fee(s) Due, U.S. Appl. No. 11/085,240, Jul. 24, 2007, 20 pages.
Y. Terao et al., U.S. PTO Office Action, U.S. Appl. No. 11/085,257, Jul. 16, 2007, 12 pgs.
Y. Terao et al., Notice of Allowance and Fee(s) Due, U.S. Appl. No. 11/008,131, Sep. 26, 2007, 12 pages.
Y. Terao et al., U.S. PTO Office Action, U.S. Appl. No. 11/008,199, Aug. 30, 2007, 18 pages.
Y. Terao et al., U.S. PTO Office Action, U.S. Appl. No. 11/008,224, Aug. 28, 2007, 8 pages.
Y. Terao et al., U.S. PTO Office Action, U.S. Appl. No.11/008,248, Aug. 22, 2007, 8 pgs.
Y. Terao et al., Notice of Allowance and Fee(s) Due, U.S. Appl. No. 11/085,264, Sep. 12, 2007, 16 pages.
Y. Terao et al., U.S. PTO Office Action, U.S. Appl. No. 11/822,611, Sep. 25, 2007, 20 pages.
Y. Terao et al., U.S. PTO Office Action, U.S. Appl. No. 11/826,731, Sep. 13, 2007, 21 pages.

* cited by examiner

SHEET POST-PROCESS DEVICE WITH STANDBY TRAY

CROSSREFERENCE TO RELATED APPLICATION

This application is based upon and claims the benefit of priority from prior Japanese Patent Application Nos. 2004-285284 filed on Sep. 29, 2004 and 2004-366522 filed on Dec. 17, 2004, the entire contents of which are incorporated herein by reference.

BACKGROUND OF THE INVENTION

1. Field of the Invention

The present invention relates to a sheet post-process apparatus for post-processing sheets of paper ejected from an image forming apparatus such as a copier, a printer, or a composite device.

2. Description of the Related Art

In recent years, in an image forming apparatus, to post-process sheets of paper after image forming such as sorting or stapling sheets of paper, a sheet post-process apparatus may be installed in the neighborhood of the paper ejection unit of the image forming apparatus body. In such a sheet post-process apparatus, after waiting for ending of the sheet post-process of preceding sheets, the post-process of succeeding sheets is performed. To make the succeeding sheets ejected from the image forming apparatus body stand by like this, conventionally, in Japanese Patent Publication 6-99070 or Japanese Patent Application 11-322162, an apparatus installing a shifting path or a buffer path halfway the path toward the stapler is disclosed.

However, as in the conventional apparatus, when a shifting path or a buffer path is installed halfway the path toward the stapler, the length of the conveying path from the paper ejection unit of the image forming apparatus body to the stapler becomes longer, thus a problem arises that miniaturization of the apparatus is disturbed.

Therefore, a sheet post-process apparatus capable of shortening the distance from the paper ejection unit of the image forming apparatus to the processing mechanism for performing the post process and realizing miniaturization is desired.

SUMMARY OF THE INVENTION

An object of this embodiment of the present invention is to provide a sheet post-process apparatus for shortening the distance from the paper ejection unit of the image forming apparatus to the processing mechanism for performing the post process and realizing miniaturization.

According to this embodiment of the present invention, the sheet post-process apparatus comprises a standby tray for making sheets ejected from an image forming apparatus stand by, a processing tray arranged under the standby tray for loading the sheets dropped and fed from the standby tray and/or the sheets ejected from the image forming apparatus not via the standby tray, a processing mechanism for post-processing the sheets loaded on the processing tray, a conveying mechanism for making contact with the sheets loaded on the processing tray so that the frictional force with the front end side becomes larger than the frictional force with the rear end side and conveying the sheets on the processing tray in the conveying direction, and a paper ejection tray for at least loading the sheets after post processed to be ejected by the conveying mechanism.

DETAILED DESCRIPTION OF THE INVENTION

Figure 1:
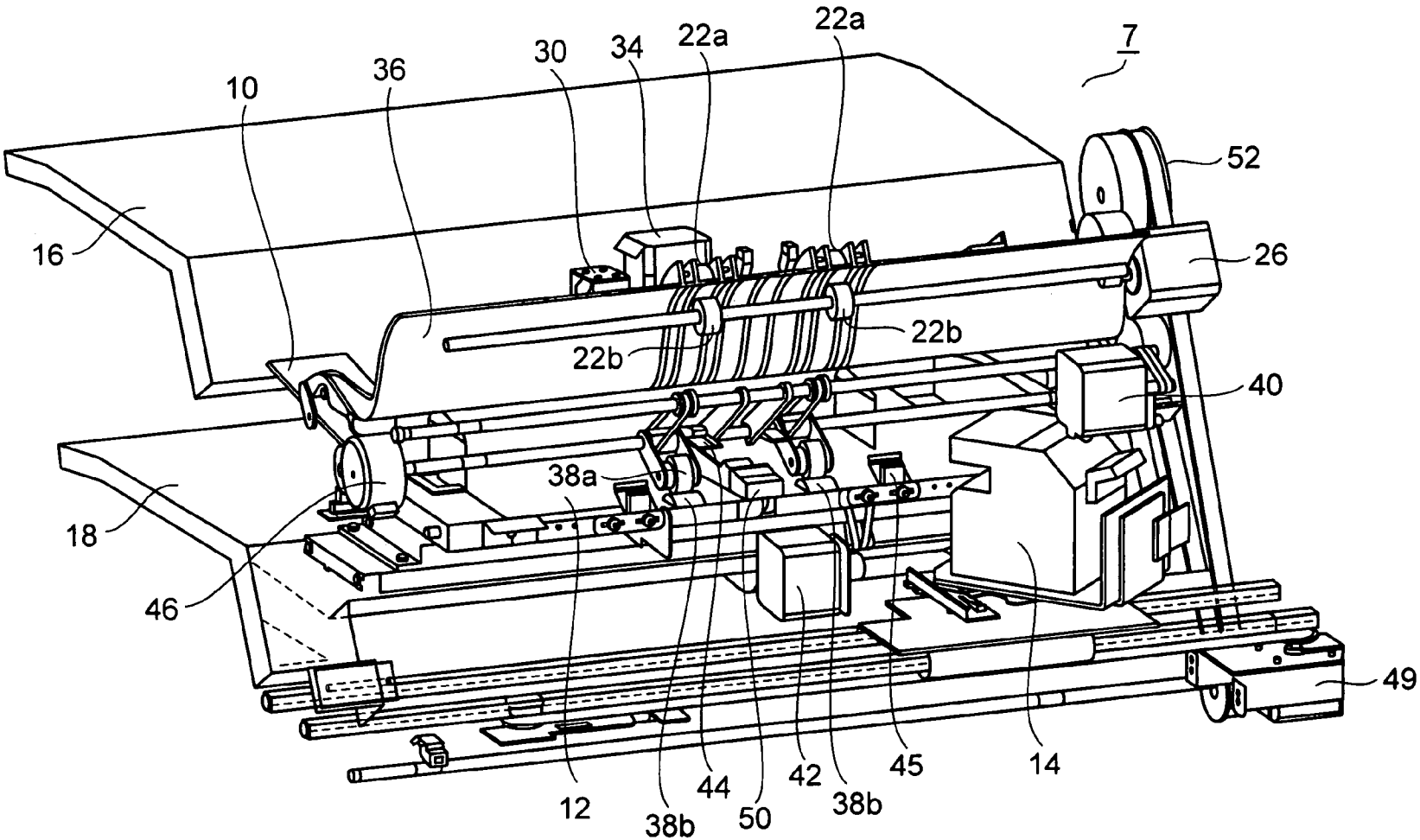
FIG. 1 is a perspective view showing the essential section of the sheet post-process apparatus of the embodiment of the present invention.
Figure 2:
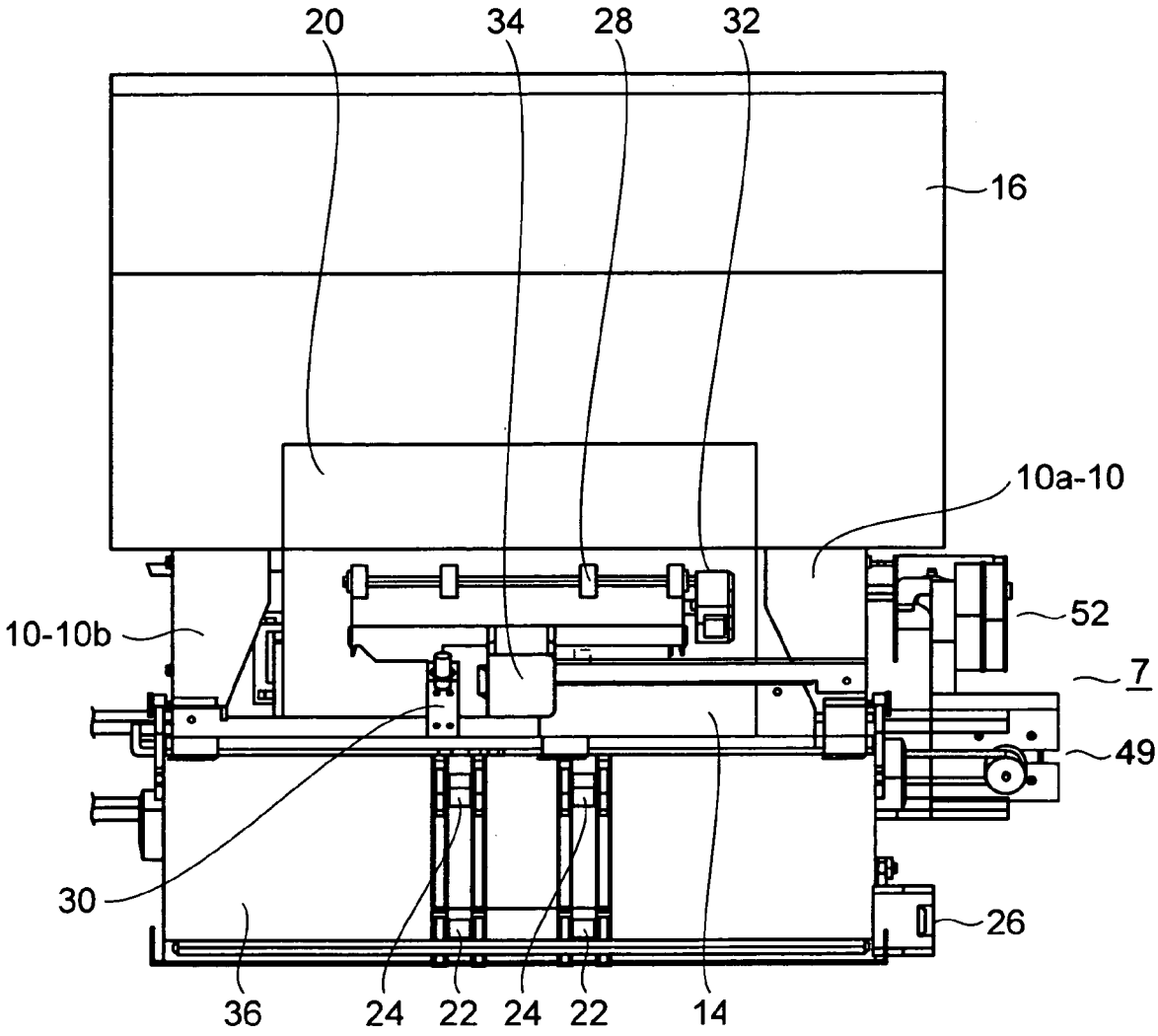
FIG. 2 is a top view showing the essential section of the sheet post-process apparatus of the embodiment of the present invention.
Figure 3:
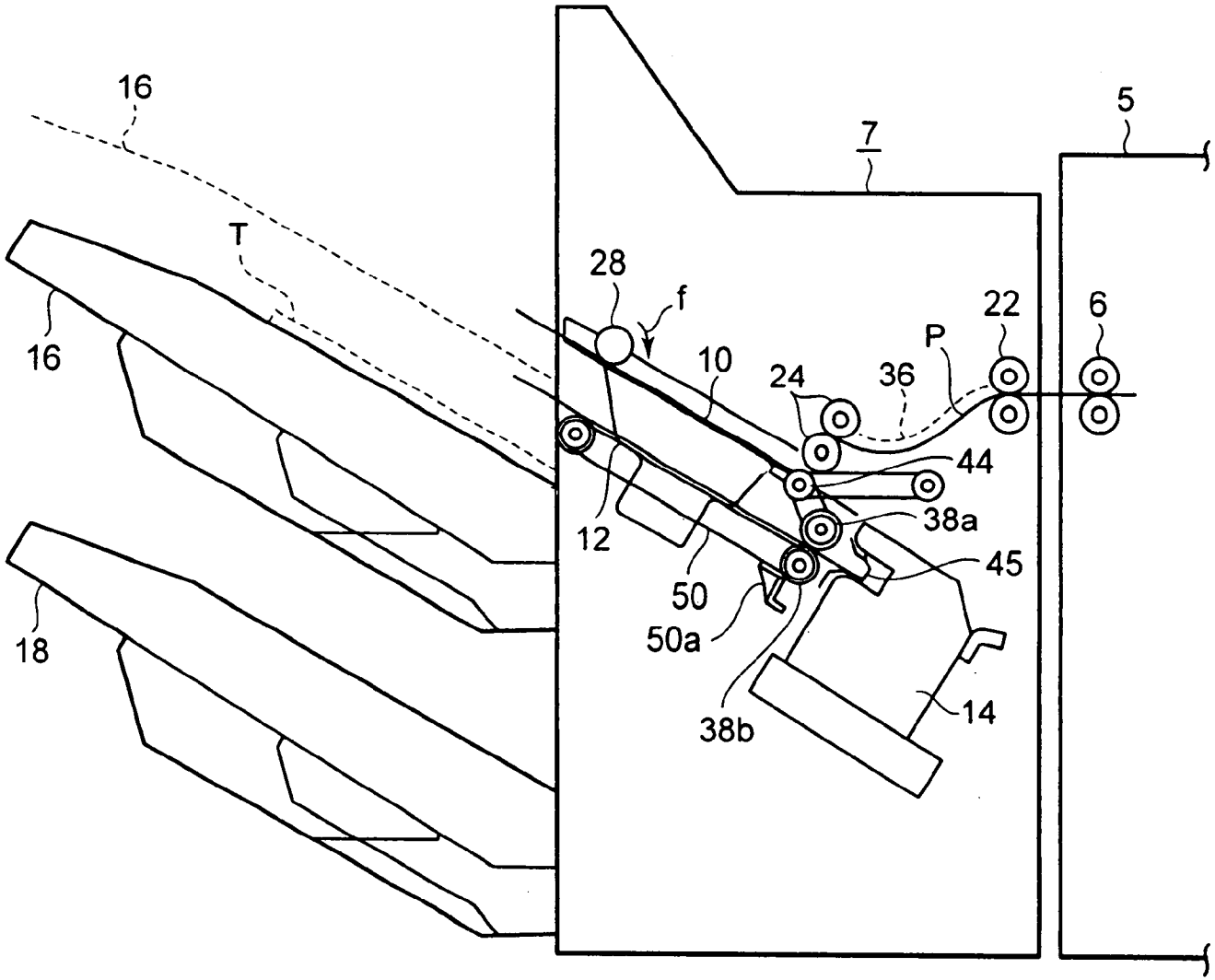
FIG. 3 is a schematic block diagram showing the sheet post-process apparatus of the embodiment of the present invention.

Hereinafter, the embodiment of the present invention will be explained in detail with reference to the accompanying drawings. FIG. 1 is a perspective view showing the essential section of a sheet post-process apparatus 7 of the embodiment of the present invention, and FIG. 2 is a top view showing the essential section of the sheet post-process apparatus, and FIG. 3 is a schematic block diagram showing the sheet post-process apparatus 7 arranged in the neighborhood of an image forming apparatus 5 such as a copier. The sheet post-process apparatus 7 has a pair of entrance rollers 22 for fetching a sheet of paper P on which an image is formed by the image forming apparatus 5 and which is ejected by a pair of paper ejection rollers 6 into the sheet post-process apparatus 7. The entrance rollers 22 are driven by an entrance roller motor 26. Between the entrance rollers 22 and a standby tray 10 which is a standby means, a paper path ceiling 36 for leading the sheets of paper P to a pair of paper feed rollers 24 is installed. Under the standby tray 10, a processing tray 12 which is a loading means for loading the sheets of paper P dropped and fed from the standby tray 10 is arranged.

Figure 4:
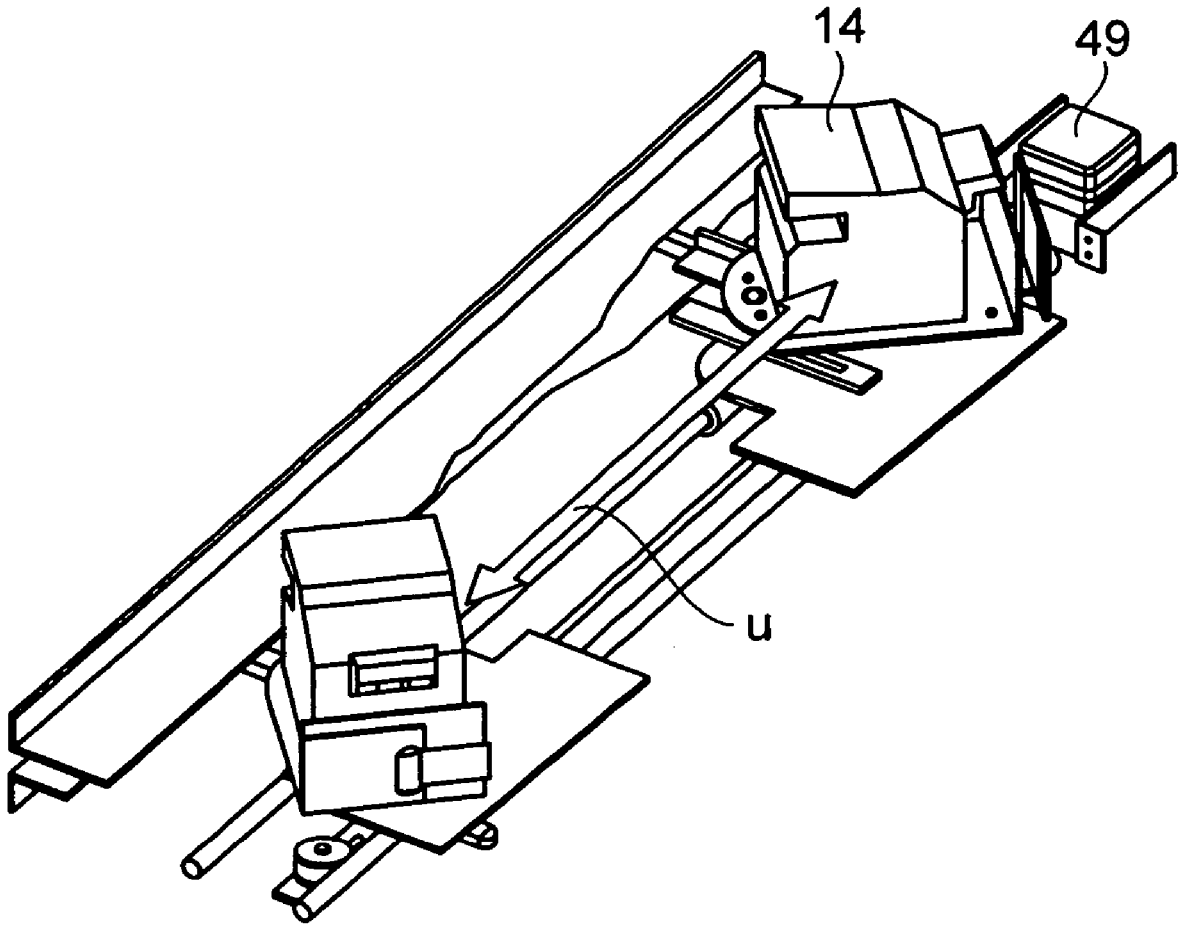
FIG. 4 is a perspective view showing the stapler of the sheet post-process apparatus of the embodiment of the present invention.

The processing tray 12, while the sheets of paper P are stapled by the stapler 14 which is a processing mechanism for performing the post-process, matches and supports the sheets of paper P to be loaded. As shown in FIG. 4, the stapler 14 can slide and move in the direction of the arrow u by a stapler driving unit 49. The stapler 14 is rotated, moved, and positioned according to the stapling direction, thus the stapling process is controlled.

Figure 5:
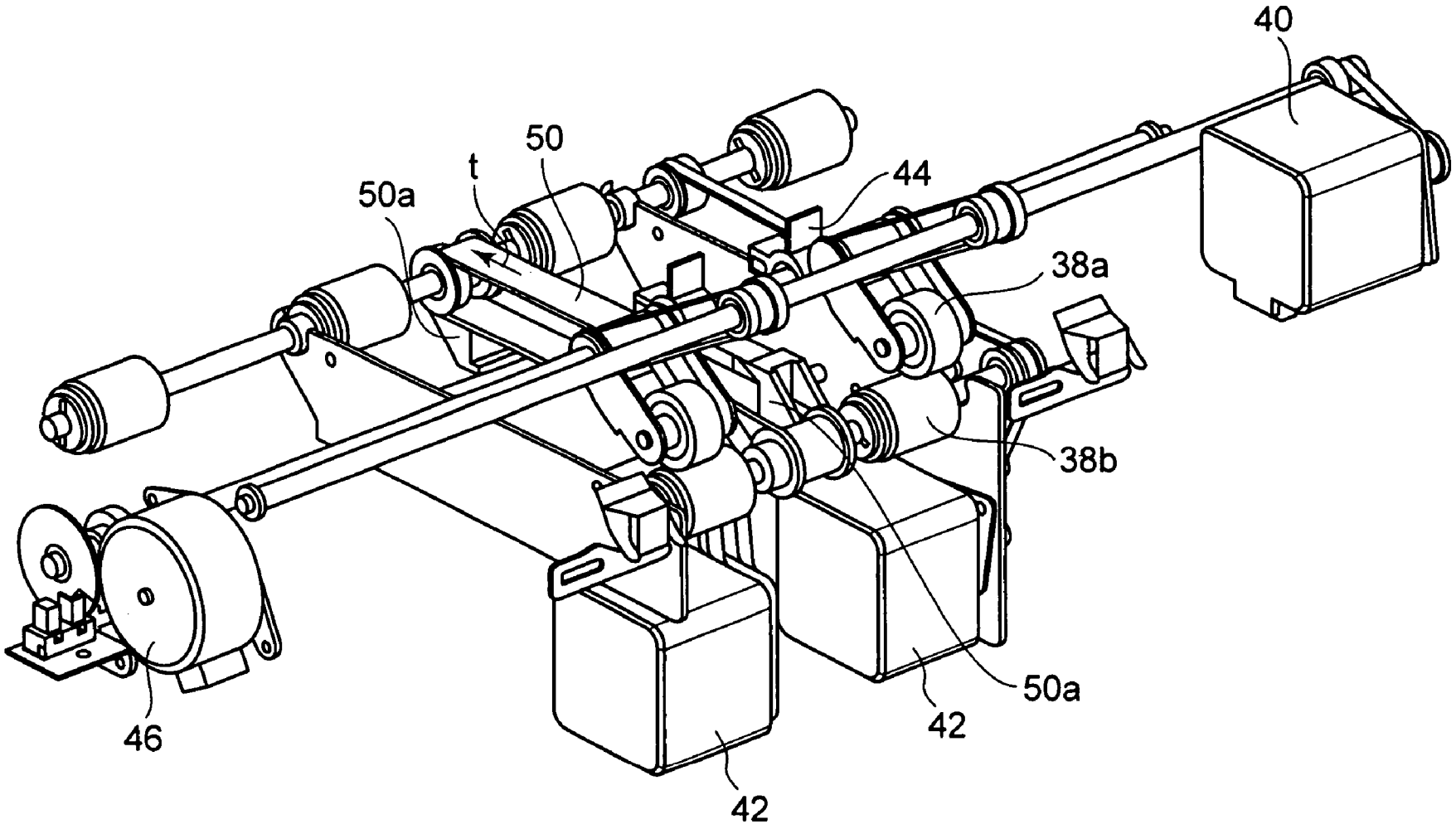
FIG. 5 is a perspective view showing the vertical matching roller of the embodiment of the present invention.

The processing tray 12 has a pair of upper vertical matching roller 38*a* and lower vertical roller 38*b* shown in FIG. 5. The upper vertical matching roller 38*a* and lower vertical roller 38*b* match a plurality of sheets of paper P dropped and fed from the standby tray 10 in the vertical direction which is a conveying direction. The upper and lower vertical matching rollers 38*a* and 38*b* serve as bundle conveying rollers for holding a sheet bundle T after stapled and taking out it from the stapler 14. The upper vertical matching roller 38*a* is driven by a vertical matching upper roller motor 40 and the lower vertical matching roller 38*b* is driven by a vertical matching lower roller motor 42.

Figure 6:
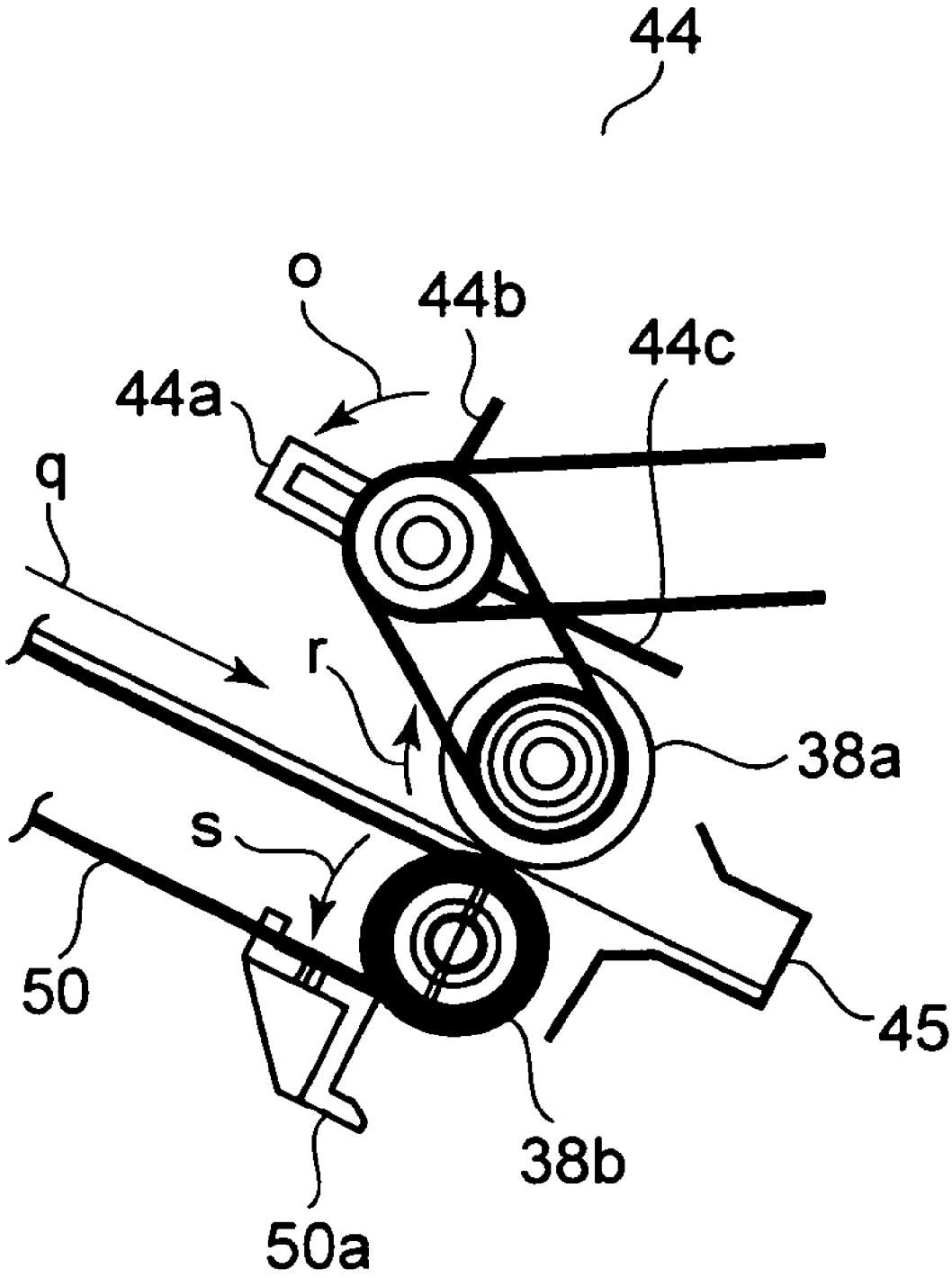
FIG. 6 is an illustration showing the paddle of the embodiment of the present invention.

Further, when the sheets of paper P are dropped and fed on the processing tray 12, at the position where the rear end of each of the sheets of paper P is dropped, a rotatable paddle 44 for matching vertically the uppermost sheet of paper P loaded on the processing tray 12 is arranged. The paddle 44, as shown in FIG. 6, has a receiving portion 44*a* of the sheets of paper P dropped and fed onto the processing tray 12, a beating portion 44*b* for beating down the sheets of paper P on the processing tray 12, and a feeding portion 44*c* for matching the sheets of paper P on the processing tray 12 and it is driven by a paddle motor 46. The paddle 44 is composed of an elastic rubber material.

At the end of the processing tray 12 on the side of the stapler 14, a stopper 45 for making contact with the rear end of each of the sheets of paper P and controlling the rear end position. Almost at the center of the processing tray 12, a conveyor belt 50 which is a conveyor mechanism for making contact with the lowest sheet of paper P on the processing tray 12 is installed. The conveyor belt 50 conveys the sheet bundle T, which is stapled and taken out from the stapler 14 by the upper and lower vertical matching rollers 38*a* and 38*b*, up to the first or second paper ejection tray 16 or 18 which is a paper ejection means. To the conveyer belt 50, a feed pawl 50*a* for hooking the rear end of the sheet bundle T is attached.

Figure 10:
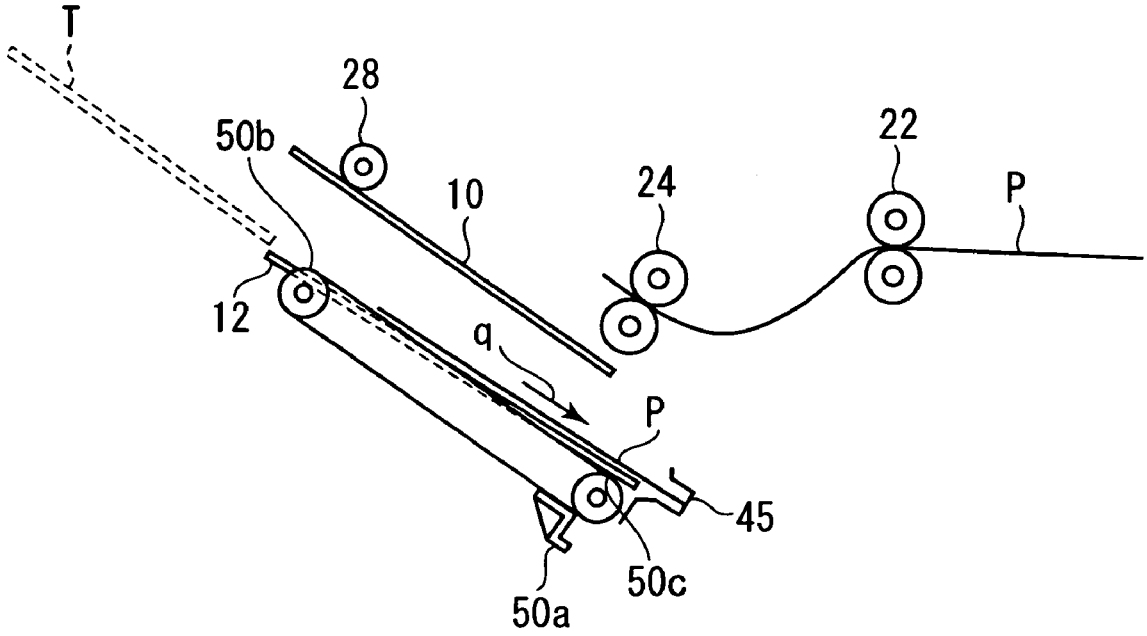
FIG. 10 is an illustration showing the angle of the conveyor belt with the processing ray of the embodiment of the present invention.

As shown in FIG. 10, the conveyor belt 50 forms an angle with the sheet support face of the processing tray 12. Namely, the conveyor belt 50 is arranged so as to be inclined so that for the sheet support face of the processing tray 12, a front end side 50*b* of the sheets of paper P is positioned higher than a rear end side 50*c* the sheets of paper P. The tilt angle of the conveyor belt 50 with the processing tray 12 is desirably 150 or lower. The front end side 50*b* of the sheets of paper P of the conveyor belt 50 is projected from the sheet support face of the processing tray 12. Further, the rear end side 50*c* of the sheets of paper P of the conveyor belt 50 is arranged lower than the sheet support face of the processing tray 12. By doing this, the frictional force of the conveyor belt 50 with the sheets of paper P is small on the rear end side 50*c* of the sheets of paper P and large on the front end side 50*b* of the sheets of paper P.

The standby tray 10 can drop and feed the sheets of paper P onto the processing tray 12 and also can convey the sheets of paper P toward the first or second paper ejection tray 16 or 18. When conveying the sheets of paper P toward the paper ejection trays 16 and 18, a standby tray roller 28 for matching the sheets of paper P makes contact with the sheets of paper P on the standby tray 10. The standby tray roller 28 is controlled in the vertical movement by a standby tray roller driving source 30 and is driven to rotate by a standby tray roller motor 32.

The standby tray 10 is inclined so that the front end of the sheets of paper P is positioned higher than the rear end thereof. The first or second paper ejection tray 16 or 18 is moved up and down by a paper ejection tray driving unit 52 and either of them is selected. The first or second paper ejection tray 16 or 18 is moved up and down up to almost the same height as that of the standby tray 10 or the processing tray 12 when loading the sheets of paper P to improve the consistency of the sheets of paper P to be ejected. The first or second paper ejection tray 16 or 18 is inclined so that the front end of the sheets of paper P is positioned higher than the rear end thereof.

Figure 7:
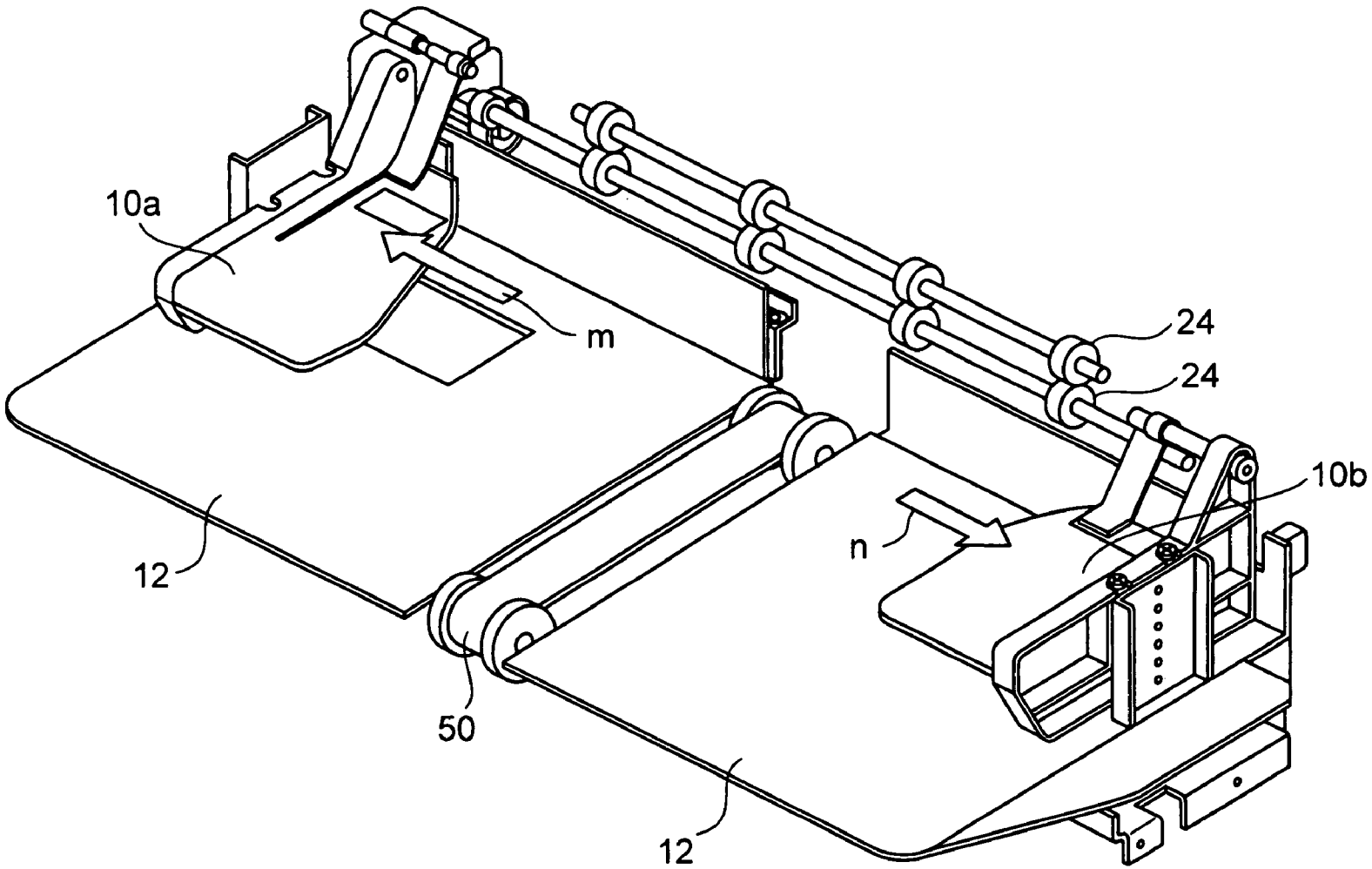
FIG. 7 is a schematic perspective view showing the standby tray and processing tray of the embodiment of the present invention.
Figure 8:
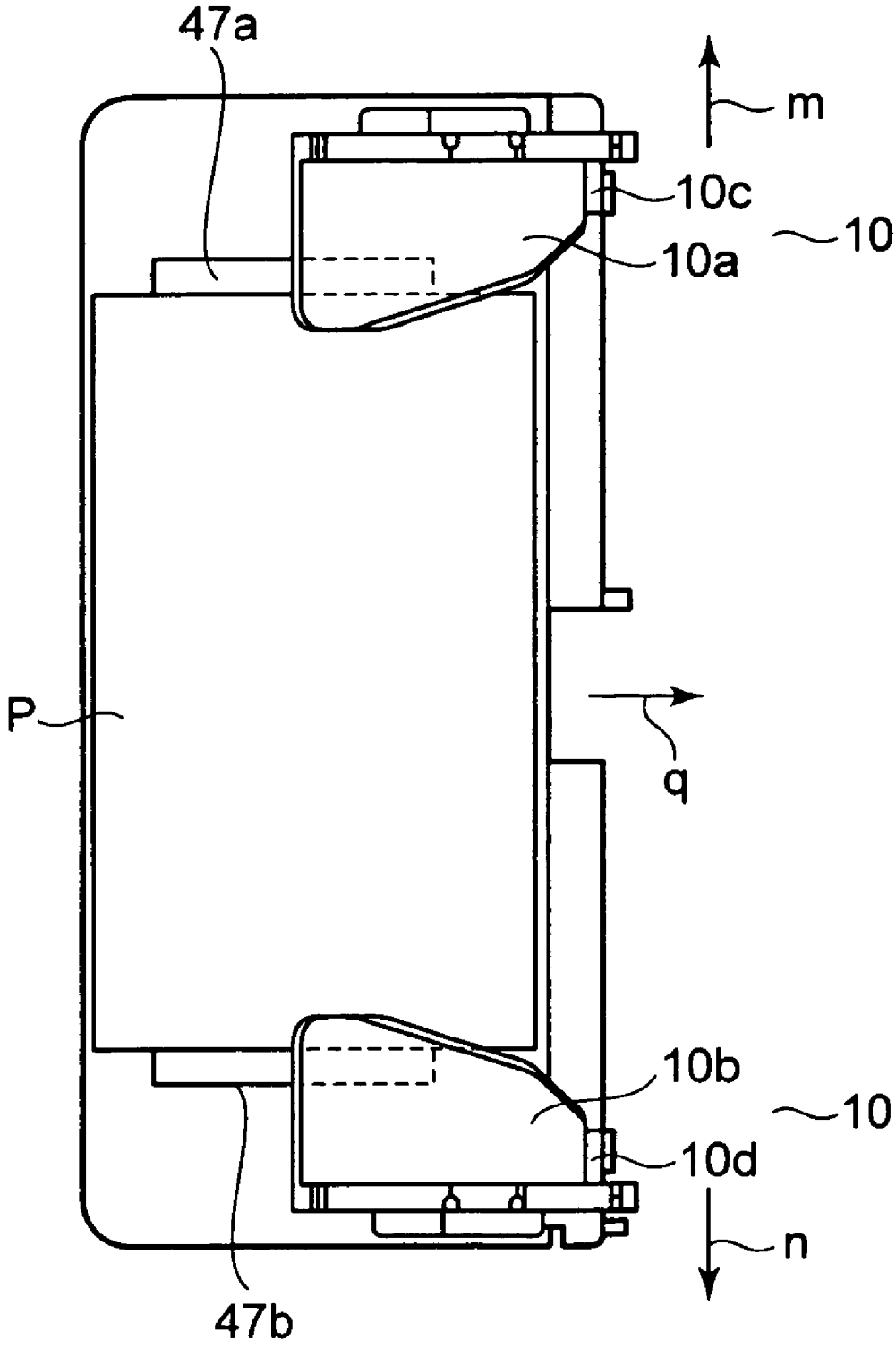
FIG. 8 is a top view showing the standby tray and processing tray of the embodiment of the present invention.
Figure 9:
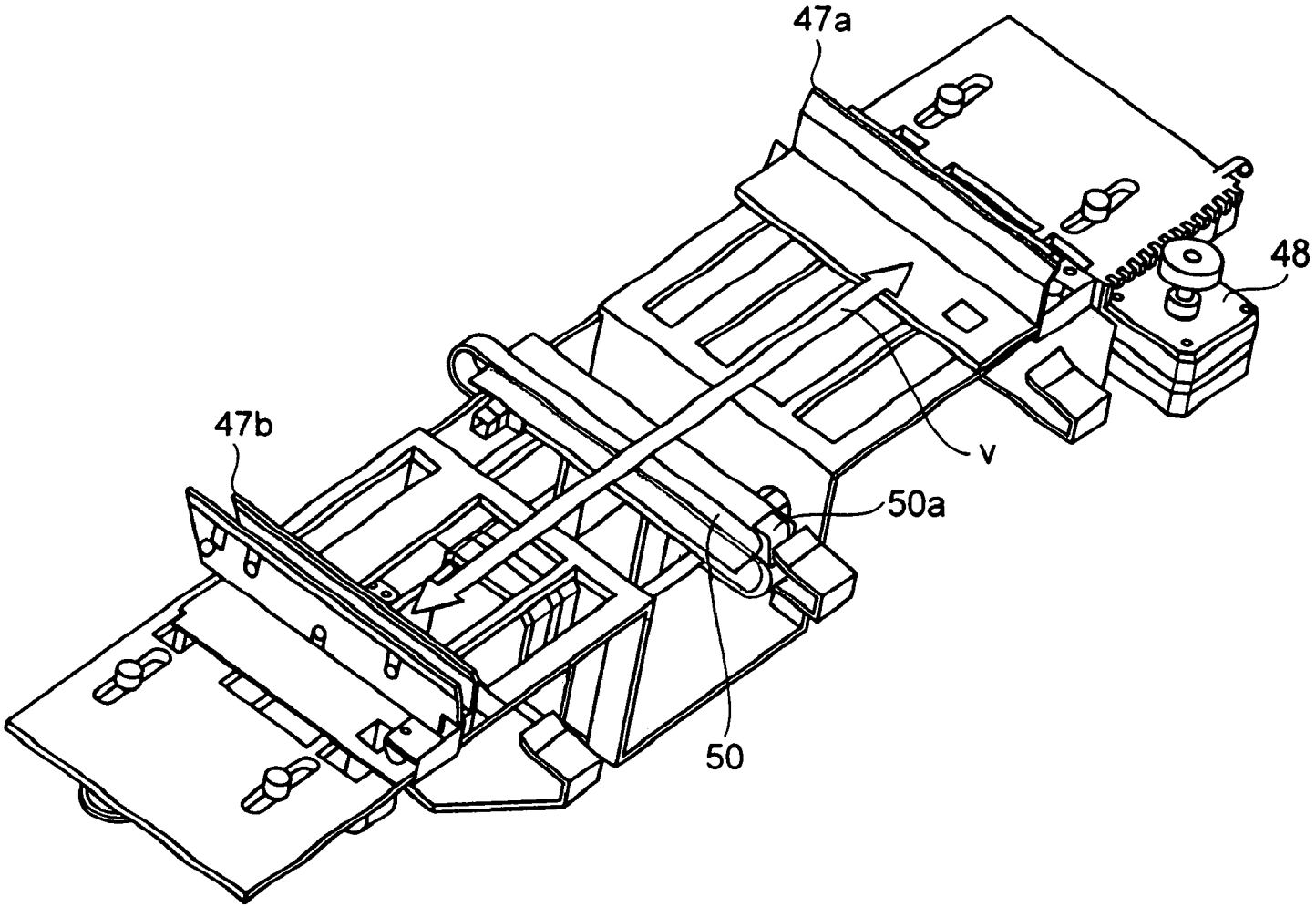
FIG. 9 is a schematic perspective view showing the horizontal matching plate and conveyor belt of the embodiment of the present invention.

As shown in FIGS. 7 and 8, the standby tray 10 has a pair of tray members 10*a* and 10*b*, receives the sheets in a state that it slides in the width of the paper P and supports both sides of the paper P. On the tray members 10*a* and 10*b*, standby stoppers 10*c* and 10*d* for controlling the rear ends of the sheets of paper P are installed. The standby tray 10 slides and moves by the standby tray motor 34. Between the standby tray 10 and the processing tray 12 where it reaches, when dropping and feeding the sheets of paper P from the standby tray 10 onto the processing tray 12, horizontal matching plates 47*a* and 47*b* shown in FIG. 9 for preventing the sheets of paper P from turning away in the horizontal direction perpendicular to the conveying direction and matching them horizontally are installed. The horizontal matching plates 47*a* and 47*b* are formed slidably in the direction of the arrow v so as to fit to the width of the sheets of paper P by a horizontal matching motor 48.

Next, the operation of the invention will be described. When an image is formed by the image forming apparatus 5 and a sheet of paper P is fed from the paper ejection rollers 6, the sheet post-process apparatus 7, depending on a case of performing the post-process of the sheet of paper P or a case of performing no post-process, or while the preceding sheet of paper P is in execution of the post-process or the post-process is finished, performs a different operation.

When the post-process is not to be performed, for example, the first paper ejection tray 16 slides and moves to the position indicated by a dotted line shown in FIG. 3 and can load the sheets of paper P ejected from the standby tray 10 in good consistency. When the post-process is not to be performed, the sheet of paper 10 conveyed from the entrance rollers 22 to the paper feed rollers 24 via the paper path ceiling 36 is fed to the standby tray 10 by the paper feed rollers 24. Then, the sheet of paper P is moved down onto the standby tray 10, is conveyed by the standby tray 28 rotating in the direction of an arrow f, and is ejected to the first paper ejection tray 16.

In this way, on the first paper ejection tray 16, sheets of paper are sequentially loaded. At this time, the first paper ejection tray 16 is inclined so that the front end side of the sheet of paper is positioned higher than the rear end side thereof. Therefore, the preceding sheet of paper P loaded on the first paper ejection tray 16 is not pressed out by making contact with the front end of the succeeding sheet of paper P. Namely, the ejected sheet of paper P is sequentially loaded on the first paper ejection tray 16 unless the order is disturbed. Further, even if the preceding sheet of paper P is pressed by the succeeding sheet of paper P and is slightly displaced, since the tilt angle is formed, the sheet of paper P drops by its own weight and is loaded on the first paper ejection tray 16 with the rear end matched, and the ejection process of the sheet of paper is completed.

Next, a case that the stapling process which is a post process is to be performed and no preceding sheet of paper P in execution of the stapling process exists on the processing tray 12 will be described. At this time, the standby tray 10 slides and moves the tray members 10*a* and 10*b* respectively up to the positions indicated by the dotted lines in FIG. 11 in the directions of arrows m and n and opens the dropping and feeding path of the sheet of paper P. Further, the horizontal matching plates 47*a* and 47*b*, to match the sheet of paper P dropping from the paper feed rollers 24 in the horizontal direction, are arranged so that the gap between the horizontal matching plates 47*a* and 47*b* is made almost equal to the width of the sheet of paper P. By doing this, the sheet of paper P fed by the paper feed rollers 24, without the conveying being obstructed by the standby tray 10, is dropped and fed directly onto the processing tray 12.

At the time of dropping and feeding, the upper vertical matching roller 38*a* is shifted upward and the receiving portion 44*a* of the paddle 44 receives the rear end of the sheet of paper P. Both sides of the sheet of paper P drop in contact with the horizontal matching plates 47*a* and 47*b* and are matched in the horizontal direction. Then, the paddle 44 rotates in the direction of an arrow o, drops the rear end of the sheet of paper P from the receiving portion 44*a*, and beats down it onto the processing tray 12 by the beating portion 44*b*. Furthermore, the paddle 44 feeds the sheet of paper P in the direction of an arrow q by the feeding portion 44*c*, and the rear end of the sheet of paper P makes contact with the stopper 45, and the vertical matching of the sheet of paper P is completed. When matching the sheet of paper P fed by the processing tray 12 on the basis of the stopper 45 like this, the rear end side 50*c* of the sheet of paper P on the conveyor belt 50 is lower than the support face of the sheet of paper P on the processing tray 12. Therefore, the contact friction of the rear end of the lowest sheet of paper P with the conveyor belt is small, and the consistency of the sheets of paper P is not disturbed, and the sheet of paper P is matched surely. Further, the vertical matching of the sheet of paper P on the processing tray 12 may be executed by, instead of the paddle 44, the upper vertical matching roller 38*a* by moving up and down each time.

In this way, the sheet of paper P on which an image is formed is loaded directly on the processing tray 12 from the paper feed rollers 24 while sequentially matching it in the horizontal direction and vertically direction. When the sheets of paper P reach a predetermined number, the stapler 14 staples the sheets of paper P on the processing tray 12 at a desired position and bundles them to form the sheet bundle T. Hereafter, the upper vertical matching roller 38*a* is moved down onto the sheet bundle and the sheet bundle T is held between the upper vertical matching roller 38*a* rotating in the direction of the arrow r and the lower vertical matching roller 38*b* rotating in the direction of the arrow s and is conveyed toward the first paper ejection tray 16.

When the rear end of the sheet bundle T passes the upper and lower vertical matching rollers 38*a* and 38*b*, it is hooked by the feed pawl 50*a* of the conveyor belt 50 rotating in the direction of the arrow t and is fed onto the first paper ejection tray 16. When feeding the sheet bundle by the conveyor belt 50, the conveyor belt 50, as moving toward the front end side 50*b* of the sheet of paper P, is inclined so as to project from the support face of the sheet of paper P on the processing tray 12. Therefore, as moving to the front end of the lowest sheet of paper P, the contact friction by the conveyor belt 50 is slowly increased and as approaching the first paper ejection tray 16, the conveying force of the sheets of paper P by the conveyor belt 50 in the conveying direction is increased. By doing this, the sheet bundle T, by the feed pawl 50*a* and the conveying force of the conveyor belt 50, is surely conveyed to the first paper ejection tray 16 free of disorder.

At this time, the first paper ejection tray 16 slides and moves from the position indicated by the dashed line in FIG. 3 to the position indicated by the solid line. Further, the first paper ejection tray 16 is arranged slantwise and the front end of the sheet of paper is positioned higher than the rear end thereof, so that the preceding sheet of paper P fed onto the first paper ejection tray 16 is not pressed out by making contact with the front end of the succeeding sheet bundle T. Further, even if the preceding sheet bundle T is slightly displaced by the succeeding sheet of paper P, since the tilt angle is formed, the sheet bundle T drops by its own weight and is loaded on the first paper ejection tray 16 with the rear end matched, and the stapling process of the sheets of paper P is completed.

Next, a case that the stapling process which is a post-process is to be performed and preceding sheets of paper P in execution of the stapling process remain on the processing tray 12 will be described. At this time, in the standby tray 10, the tray members 10*a* and 10*b* slide and move from the positions indicated by the dashed lines in FIG. 11 respectively in the opposite direction of the direction of the arrow m or in the opposite direction of the direction of the arrow n, and are at the positions indicated by the solid lines shown in FIG. 11, and can support the sheet of paper P. Further, the standby tray roller 28 is shifted above the standby tray 10 not to disturb the sheets of paper P. The sheets of paper P ejected from the image forming apparatus 5 and fed by the paper feed rollers 24 are loaded once on the standby tray 10 to wait for the processing tray 12 to be free.

The sheets of paper P loaded on the standby tray 10 are moved down onto the standby tray 10, are sent toward the standby stoppers 10*c* and 10*d* by the standby tray roller 28 rotating in the opposite direction of the direction of the arrow f, and are vertically matched with the rear end of the sheets of paper P in contact with the standby stoppers 10*c* and 10*d*. Furthermore, the first paper ejection tray 16 is arranged slantwise so that the front end of the sheets of paper is positioned higher than the rear end thereof, thus the sheets of paper P are vertically matched by the own weight with the rear end thereof in contact with the standby stoppers 10*c* and 10*d*.

The standby tray 10 is arranged slantwise, so that for example, even if the sheet of paper P is fed from the paper feed rollers 24 in a state that it is curled convexly and is fed to the standby tray 10, the preceding sheet of paper P loaded on the standby tray 10 is not pressed out by making contact with the front end of the succeeding sheet of paper P. Namely, the fed sheet of paper P is sequentially loaded on the standby tray 10 unless the order is disturbed. Further, even if the preceding sheet of paper P is pressed by the succeeding sheet of paper P and is slightly displaced, since the tilt angle is formed, the sheet of paper P drops by its own weight down to the position where the rear end thereof makes contact with the standby stoppers 10*c* and 10*d* and is loaded on the standby tray 10 with the rear end matched.

Figure 11:
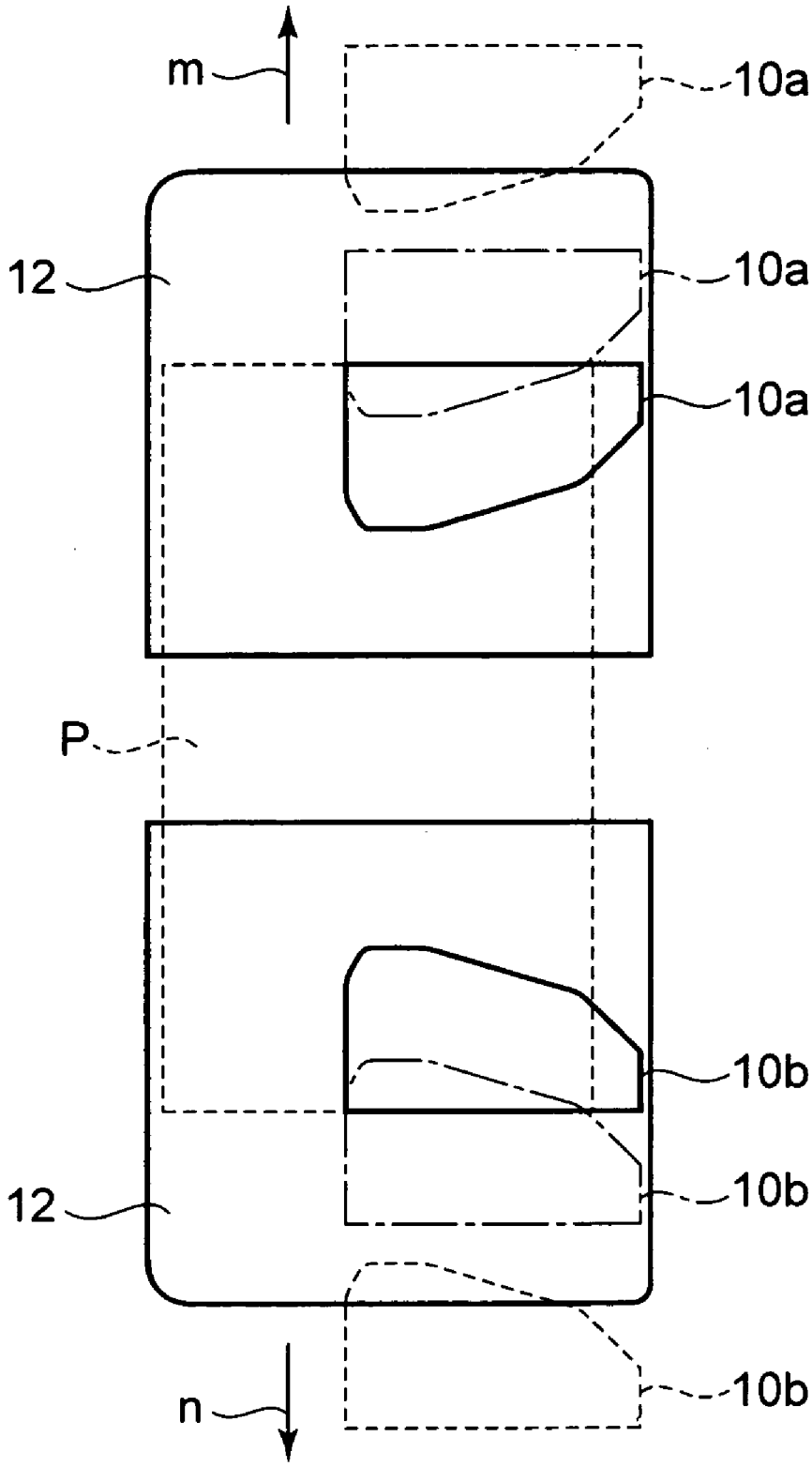
FIG. 11 is an illustration showing movement of the standby tray of the embodiment of the present invention.

During this period, when the preceding sheet of paper P on the processing tray 12 is ejected on the side of the paper ejection tray 16 and the processing tray 12 becomes free, the standby tray 10 slides and moves the tray members 10*a* and 10*b* respectively up to the positions indicated by the dotted lines in FIG. 11 in the directions of the arrows m and n from the positions indicated by the solid lines in FIG. 11 via the positions indicated by the alternate long and short dash line in FIG. 11. By doing this, for example, two sheets of paper P standing by on the standby tray 10, when the tray members 10*a* and 10*b* reach the positions indicated by the alternate long and short dash line in FIG. 11, are dropped and fed onto the processing tray 12 from between the tray members 10*a* and 10*b*. At this time, the horizontal matching plates 47*a* and 47*b* are arranged so as to make the interval between them almost equal to the width of the sheets of paper P. Therefore, the sheets of paper P dropped from the standby tray 10 are controlled on both sides by the horizontal matching plates 47*a* and 47*b* and are matched horizontally.

The lower side sheet of paper P of the two sheets of paper P dropped onto the processing tray 12 is sent in the direction of the arrow q by the lower vertical matching roller 38*b* rotating in the opposite direction of the direction of the arrow s, and the rear end of the sheet of paper P makes contact with the stopper 45, and the vertical matching of the sheet of paper P is completed. The upper side sheet of paper P of the two sheets of paper P dropped onto the processing tray 12 is sent in the direction of the arrow q by the upper vertical matching roller 38*a* rotating in the opposite direction of the direction of the arrow r. By doing this, the rear end of the sheet of paper P makes contact with the stopper 45 and the vertical matching of the sheet of paper P is completed. Thereafter, the upper vertical matching roller 38*a* is shifted upward. When matching the sheet of paper P fed by the processing tray 12 on the basis of the stopper 45 like this, the rear end side 50*c* of the sheet of paper P on the conveyor belt 50 is lower than the support face of the sheet of paper P on the processing tray 12. Therefore, the contact friction of the rear end of the lowest sheet of paper P with the conveyor belt is small, and the consistency of the sheets of paper P is not disturbed, and the sheet of paper P is matched surely.

The third and subsequent sheets of paper P ejected from the image forming apparatus 5 are directly dropped and fed onto the processing tray 12 from between the tray members 10*a* and 10*b* without standing by on the standby tray 10. Hereafter, the third and subsequent sheets of paper P are sequentially matched on the sheets of paper P loaded earlier on the processing tray 12 by the paddle 44.

When the sheets of paper P loaded on the processing tray 12 reach a predetermined number, the sheets are stapled by the stapler 14 to form a sheet bundle T. Hereafter, the sheet bundle T is conveyed toward the first paper ejection tray 16 by the upper and lower vertical matching rollers 38*a* and 38*b*. Furthermore the rear end of the sheet bundle T passing through the upper and lower vertical matching rollers 38*a* and 38*b* is hooked by the feed pawl 50*a* of the conveyor belt 50 and by the conveying force of the conveyor belt 50 whose contact friction with the sheets of paper P is slowly increased as approaching the first paper ejection tray 16, the sheet bundle is surely conveyed to the first paper ejection tray 16 free of disorder, and the stapling process is completed.

According to this embodiment, when the stapling process is to be performed after image forming and the preceding stapling process is not finished on the processing tray 12, the standby tray 10 is installed above the processing tray 12 and waits for the succeeding sheets of paper P. And, waiting for the processing tray 12 to become free, the sheets of paper P standing by on the standby tray 10 are dropped and fed and then are moved to the processing tray 16. Therefore, the practical conveying path from the standby tray 10 in the sheet post-process apparatus 7 to the processing tray 12 can be shortened and the sheet post-process apparatus can be miniaturized.

Further, the conveyor belt 50 is arranged slantwise to the support face of the sheets of paper P on the processing tray 12 and the front end side 50*b* of the sheets of paper P of the conveyor belt 50 is projected from the processing tray 12 and the rear end side 50*c* of the sheets of paper P of the conveyor belt 50 is arranged lower than the sheet support face of the processing tray 12. Therefore, the frictional force of the conveyor belt 50 with the sheets of paper P is small on the rear end side 50*c* greatly affecting the consistency of the sheets of paper P and the frictional force with the sheets of paper P is large on the front end side 50*b* greatly affecting the conveyability of the sheets of paper P. As a result, the consistency of the sheets of paper P on the processing tray 12 is not disturbed, and the sheets of paper P can be matched surely, and a highly precise stapling process can be obtained. Furthermore, when ejecting the sheet bundle T after stapling, as approaching the first paper ejection tray 16, the conveying force of the sheet bundle T by the conveyor belt 50 in the paper ejection direction can be increased. As a result, even if the sheet bundle T is particularly thick, it can be conveyed surely and satisfactory conveying is realized free of defective paper ejection such as the lowest sheet of paper P being disordered.

Further, the present invention is not limited to the aforementioned embodiment and can be variously modified within the scope of the present invention. For example, the method for dropping and feeding sheets from the standby tray onto the processing tray is not limited and the standby tray rotates and moves instead of sliding and moving, thus sheets of paper on the standby tray may be dropped and fed onto the processing tray. Further, the processing mechanism, if it is a post process to be performed for sheets, is not limited to the stapler and it may be a hole puncher. Furthermore, the angle of the conveying mechanism with the processing tray is not limited and an angle which will not disturb the consistency of sheets on the processing tray and can satisfactorily eject post-processed sheets in the paper ejection direction is acceptable.

As described in detail above, according to the present invention, the standby tray for making sheets stand by is installed above the processing tray for performing the post process and the sheets standing by on the standby tray are dropped and fed onto the processing tray. Therefore, in the apparatus, the distances occupied by the standby tray and processing tray can be overlapped, and the practical conveying path from the paper ejection unit of the image forming apparatus body to the processing mechanism for performing the post process can be shortened, and the sheet post-process apparatus can be miniaturized.

Furthermore, on the rear end side of sheets greatly affecting the consistency of sheets on the processing tray, the frictional force of the conveying mechanism with sheets is small and on the front end side of sheets greatly affecting the conveyability of sheets, the frictional force of the conveying mechanism with sheets is large. Therefore, there is no fear that the consistency of sheets on the processing tray may be disturbed, and the post process can be performed with high precision in a satisfactory matching state, and the ejectability of sheets is improved, and defective conveying such as disorder of sheets is prevented, and satisfactory bundle conveying can be executed.

What is claimed is:

1. A sheet post-process apparatus, comprising:

a standby tray that makes sheets ejected from an image forming apparatus stand by, a processing tray arranged under said standby tray that loads said sheets dropped and fed from said standby tray or sheets ejected from said image forming apparatus not via said standby tray, a processing mechanism that post-processes said sheets loaded on said processing tray, a conveyor belt arranged at a different slope from that of said processing tray so that a front end side of said conveyor belt is positioned higher than a rear end side of said conveyor belt, the front end side of said conveyor belt being projected above a support face of said sheets on said processing tray and making contact with a lowest sheet on said processing tray, and a rear end of the conveyer belt being arranged lower than the support face of the processing tray and a paper ejection tray that at least loads said sheets after ending of said post process to be ejected by said conveyor belt.

2. The sheet post-process apparatus according to claim 1, further comprising a stopper arranged in an eject direction end side of said sheets of said processing tray, and a paddle that aligns said sheets by striking an end side of said sheets loaded on said processing tray together with said stopper.

3. The sheet post-process apparatus according to claim 1, wherein said conveyor belt has a feed pawl for hooking said rear ends of said sheets so to convey said sheets for said paper ejection tray.

4. The sheet post-process apparatus according to claim 1, wherein said processing mechanism is a stapler for bundling the plurality of sheets loaded on said processing tray.

5. The sheet post-process apparatus according to claim 1, wherein said standby tray is composed of at least a pair of tray members for respectively supporting both sides of said sheets and slides and moves said tray members to drop and feed said sheets onto said processing tray.

6. The sheet post-process apparatus according to claim 1, wherein said standby tray is composed of at least a pair of tray members for respectively supporting both sides of said sheets and rotates and moves said tray members to drop and feed said sheets onto said processing tray.

7. The sheet post-process apparatus according to claim 1, wherein said paper ejection tray can load said sheets ejected from said standby tray not via said processing tray.

8. A sheet post-process apparatus, comprising:

standby means for making sheets ejected from an image forming apparatus stand by, loading means arranged under said standby means for loading said sheets dropped and fed from said standby means or sheets ejected from said image forming apparatus not via said standby means, processing means for post-processing said sheets loaded on said loading means, conveying means for conveying said sheets on said standby means in a conveying direction, the conveying means being arranged at said loading means so that a front end side of said conveying means is positioned higher than a rear end side of said conveying means, the front end side of the conveying means being projected above a support face of said sheets on said loading means and making contact with a lowest sheet on said loading means, and a rear end of the conveyer means being arranged lower than the support face of the loading means and paper ejection means for at least loading said sheets after ending of said post process to be ejected by said conveying means.

9. The sheet post-process apparatus according to claim 8, further comprising a stopper means for striking an end side of eject direction of said sheets loaded on said loading means, paddle means for aligning said sheets by striking an end side of said sheets loaded on said loading means together with said stopper means.

10. The sheet post-process apparatus according to claim 8, wherein said conveying means has a feed pawl for hooking said rear ends of said sheets so to convey said sheets for said paper ejection means.

11. The sheet post-process apparatus according to claim 8, wherein said processing means is a stapler that bundles said plurality of sheets loaded on said loading means.

12. The sheet post-process apparatus according to claim 8, wherein said standby means includes at least a pair of tray members for respectively supporting both sides of said sheets and slides and moves said tray members to drop and feed said sheets onto said loading means.

13. The sheet post-process apparatus according to claim 8, wherein said standby means includes at least a pair of tray members for respectively supporting both sides of said sheets and rotates and moves said tray members to drop and feed said sheets onto said loading means.

14. The sheet post-process apparatus according to claim 8, wherein said paper ejection means can load said sheets ejected from said standby means not via said loading means.

* * * * *